US005918923A

United States Patent [19]

Killion

[11] Patent Number: 5,918,923

[45] Date of Patent: Jul. 6, 1999

[54] PIPE LAYING ATTACHMENT FOR HYDRAULIC EQUIPMENT

[76] Inventor: Richard L. Killion, 1829 McClusky Rd., Jerseyville, Ill. 62052

[21] Appl. No.: 08/833,102

[22] Filed: Apr. 4, 1997

[51] Int. Cl.[6] ..... B66C 1/44

[52] U.S. Cl. ..... 294/88; 294/86.41; 294/115; 294/902

[58] Field of Search ..... 294/67.31, 81.51, 294/81.61, 86.41, 88, 106, 110.1, 115, 902; 405/154; 414/731, 739

[56] References Cited

U.S. PATENT DOCUMENTS

| | | | |
|---|---|---|---|
| Re. 29,869 | 12/1978 | Niederer, Jr. et al. . | |
| 1,717,194 | 6/1929 | Daoust | 294/106 |
| 3,038,620 | 6/1962 | Collin . | |
| 3,433,376 | 3/1969 | Jordan | 294/88 X |
| 3,451,711 | 6/1969 | Carpenter | 294/115 X |
| 3,561,615 | 2/1971 | Forsberg et al. | 294/81.61 X |
| 3,627,372 | 12/1971 | Carpenter et al. | 294/106 X |
| 3,807,695 | 4/1974 | Gremillion et al. . | |
| 3,834,566 | 9/1974 | Hilfiker . | |
| 3,897,099 | 7/1975 | Scodino et al. | 294/106 X |
| 3,958,704 | 5/1976 | Wire et al. . | |
| 4,030,746 | 6/1977 | Lanaowski | 294/106 X |
| 4,212,577 | 7/1980 | Swanson . | |
| 4,304,433 | 12/1981 | Langowski | 294/115 X |
| 4,451,194 | 5/1984 | Keats et al. . | |
| 4,480,942 | 11/1984 | Farrow . | |
| 4,545,609 | 10/1985 | Pasquazzi et al. | 294/106 X |
| 5,048,172 | 9/1991 | Gravenhorst . | |
| 5,061,150 | 10/1991 | Rentschler . | |
| 5,219,265 | 6/1993 | Recker . | |
| 5,256,021 | 10/1993 | Wolf et al. . | |
| 5,795,101 | 8/1998 | Bill | 294/86.41 X |

*Primary Examiner*—Johnny D. Cherry
*Attorney, Agent, or Firm*—Polster, Lieder Woodruff & Lucchesi

[57] ABSTRACT

An attachment for a hydraulically powered device such as an excavator or backhoe is provided, the attachment comprising an elongate frame; two elongate jaws, each jaw being pivotably mounted to the frame along a proximal long edge of the jaw, and an elastomeric liner on an inside surface of each jaw, the jaws being moveable between an open position in which distal long edges of the jaws are spaced apart sufficiently to receive a pipe segment and a closed position in which the distal long edges are pivoted toward each other sufficiently to grip the pipe along substantially the entire length of the jaws. A dual-acting hydraulic cylinder has an upper end attached to the frame and a second end attached to a pivot rod, the first and second links being pivotably attached to the pivot rod. The links are positioned so as to overcenter when the jaws are closed, thereby locking the jaws closed until the hydraulic cylinder is driven to its contracted position. The frame is pivotably mounted to an adapter which mounts the attachment to the hydraulic device, the adapter pivot being centered with respect to the frame, so that the frame is symmetric with respect to the pivot. The attachment is so constructed that it has minimal width relative to the size of the pipe it is handling, and thereby reduces the size of the trench which must be dug for the pipe.

19 Claims, 2 Drawing Sheets

PIPE LAYING ATTACHMENT FOR HYDRAULIC EQUIPMENT

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

This invention relates to the art of laying pipe, particularly water mains.

Municipal water mains are made of various materials. Smaller mains, under about twelve inches in diameter, are made of plastic, usually PVC, while larger mains are made of ductile iron. Both types of pipe are generally formed with a male portion at one end of each pipe segment which fits into the free female end of the adjoining pipe and seals to it. Generally, the female end is formed as a bell of greater outside diameter than the length of the pipe.

Presently, water mains are laid by digging a trench of the appropriate depth, typically several feet, and width, typically only a few inches wider than the pipe diameter, usually by means of a power trencher, excavator or backhoe. The pipe is then laid with the aid of a crane or other grappling device and a worker in the trench who guides the pipe into position and moves it forward axially into engagement with the female end of the previously laid pipe segment.

It has long been recognized that this process is tedious, time-consuming, and expensive. To solve these problems, several proposals have been made for pipe-handling attachments for power equipment. These attachments are intended to allow the operator of the equipment to handle pipe segments without aid. For example, Hilfiker, U.S. Pat. No. 3,834,566, uses a shaft attached to the rear of a bucket of a conventional backhoe excavator. The shaft is inserted into the end of a pipe section and supports the pipe as it is lowered into the trench. This approach is simple, but it does not provide any positive connection to the pipe, so that the beam must be tilted slightly upward to prevent the pipe from slipping off it. This is a problem in itself, and it has the consequence that the forward, male end of the pipe section, which must be mated to the previously-laid pipe line, is higher than the other end of the section. Therefore, mating the sections is difficult. The system is likewise liable to scratch iron pipe or break plastic pipe.

A more recent example of such an attachment is Recker, U.S. Pat. No. 5,219,265. In this patent, a grapple assembly is attached to the stick or crowd arm of a tracked hydraulic excavator. The grapple provides a more positive grip on the pipe, and the device permits the pipe segment to be angled downwardly as it is placed in the trench. It depends, however, on eccentric mounting of both the pivot which attaches it to the excavator and the pair of tongs which grip the pipe segment, and therefore makes handling and orienting pipe segments more difficult. It is apt to scratch iron pipe and damage plastic pipe. It also appears to require a trench much wider than the outer diameter of the pipe, and thus requires a great deal of extra earth removal.

BRIEF SUMMARY OF THE INVENTION

One of the objects of this invention is to provide a simple attachment for a backhoe or other hydraulic equipment which will greatly simplify the task of laying pipe segments in a trench.

Another object is to provide such an attachment which will handle both metal and plastic pipe.

Another object is to provide such an attachment which is easily modified to handle pipe of different diameters.

Another object is to provide a method of laying pipe using such an attachment.

Other objects will be apparent to those skilled in the art in the light of the following description and accompanying drawings.

In accordance with one aspect of the present invention, generally stated, an attachment for a hydraulically powered device is provided, the attachment comprising an elongate frame; two elongate jaws, each jaw being pivotably mounted to the frame along a proximal long edge of the jaw, and an elastomeric liner on an inside surface of each jaw, the jaws being moveable between an open position in which distal long edges of the jaws are spaced apart sufficiently to receive a pipe segment and a closed position in which the distal long edges are pivoted toward each other sufficiently to grip the pipe along substantially the entire length of the jaws. As used herein, the term "hydraulic device" includes any device having a hydraulically controlled crowd arm and a hydraulically controlled crowd linkage at the end of the crowd arm. It includes, for example, hydraulic wheeled and tracked excavators and tractor loader backhoes. The elastomer preferably includes a raised pattern on its surface, the pattern being compressed against the pipe when the jaws are closed.

In accordance with another aspect of the invention, an attachment for a hydraulically powered device is provided, the attachment comprising an elongate frame having long parallel edges; a first jaw pivotably mounted to one long edge of the frame and a second jaw pivotably mounted to the other long edge of the frame, the jaws being moveable between an open position in which distal ends of the jaws are spaced apart sufficiently to receive a pipe segment and a closed position in which the distal long ends are pivoted toward each other sufficient to grip the pipe; a first link pivotably attached to the first jaw, a second link pivotably attached to the second jaw, and a dual-acting hydraulic cylinder having an upper end attached to the frame and a second end attached to a pivot rod, the first and second links being pivotably attached to the pivot rod. The dual-acting hydraulic cylinder has both pressure and return lines, to control both expansion and contraction of the cylinder. Preferably, the pivot rod is slidably mounted to the frame in a slide mount comprising a pair of spaced-apart rails at each end of the pivot rod. Also preferably, two first links, two second links, two hydraulic cylinders, and two pivot pins are provided, one set at each end of the frame. Extension of the hydraulic cylinder closes the jaws. Preferably, the links are positioned so as to overcenter when the jaws are closed, thereby locking the jaws closed until the hydraulic cylinder is driven to its contracted position. In any event, the link mechanism provides effectively a system in which the pipe segment is locked in the jaws should the hydraulic system fail. The frame is pivotably mounted to an adapter which mounts the attachment to the hydraulic device, the adapter pivot being centered with respect to the frame, so that the frame is symmetric with respect to the pivot.

In accordance with another aspect of the invention, an attachment for a hydraulically powered device is provided, the attachment comprising an elongate frame having long parallel edges, and two elongate jaws, each jaw being pivotably mounted to the frame along a proximal long edge of the jaw, the jaws being moveable between an open position in which distal long edges of the jaws are spaced apart sufficiently to receive a pipe segment and a closed position in which the distal long edges are pivoted toward each other sufficiently to grip the pipe along substantially the entire length of the jaws, the device being so proportioned that when the jaws are in an open position the total width of the device is no greater than about five inches more than the outside diameter of the portion of the pipe gripped by the jaws. The frame is pivotably mounted to an adapter which mounts the attachment to the hydraulic device, the adapter pivot being centered with respect to the frame, so that the frame is symmetric with respect to the pivot.

Other aspects of the invention will be apparent from the following description of the preferred embodiment.

DETAILED DESCRIPTION OF THE INVENTION

Figure 1:
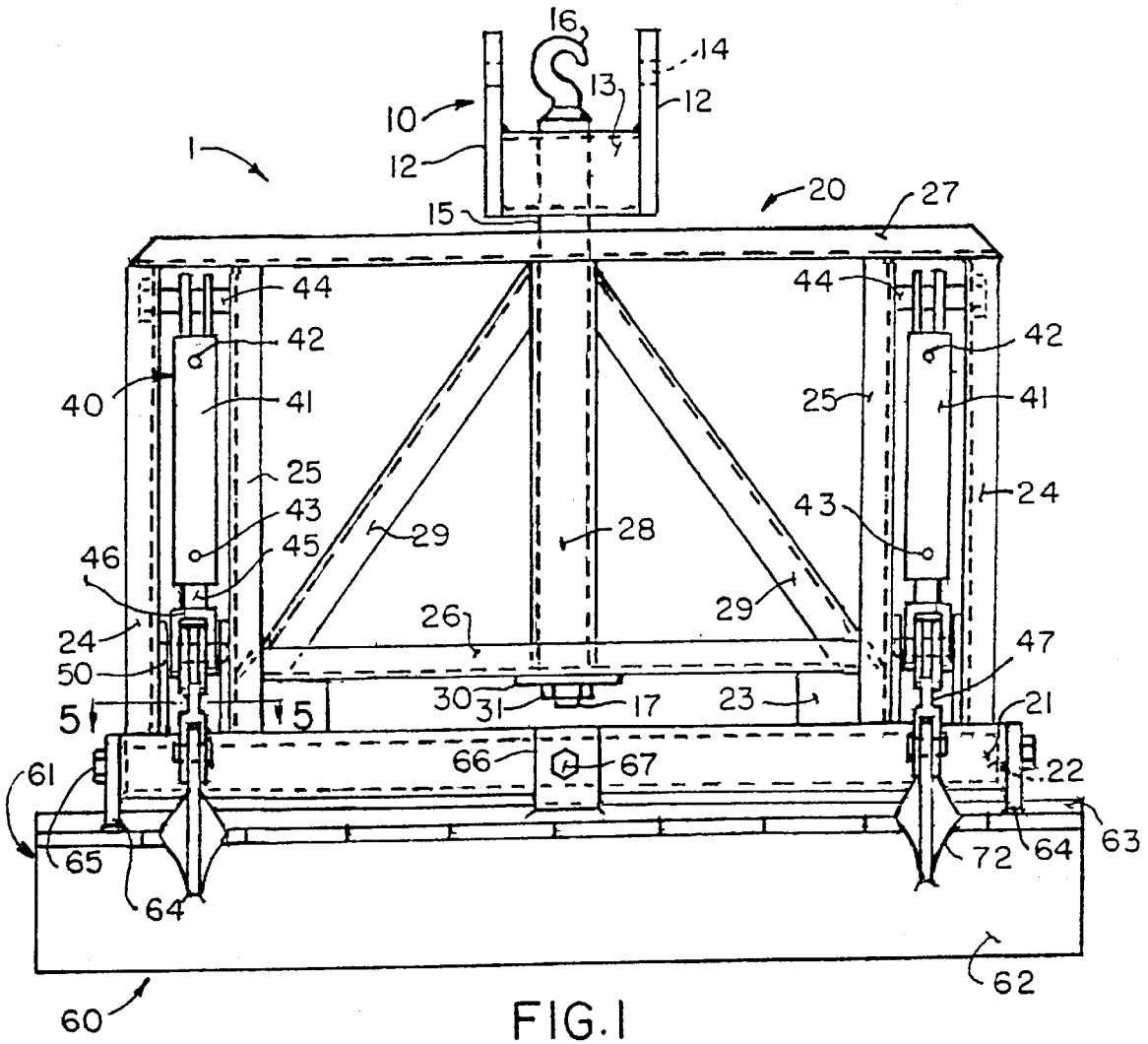
FIG. 1 is a view in side elevation of a preferred embodiment of pipe laying attachment of the present invention.
Figure 2:
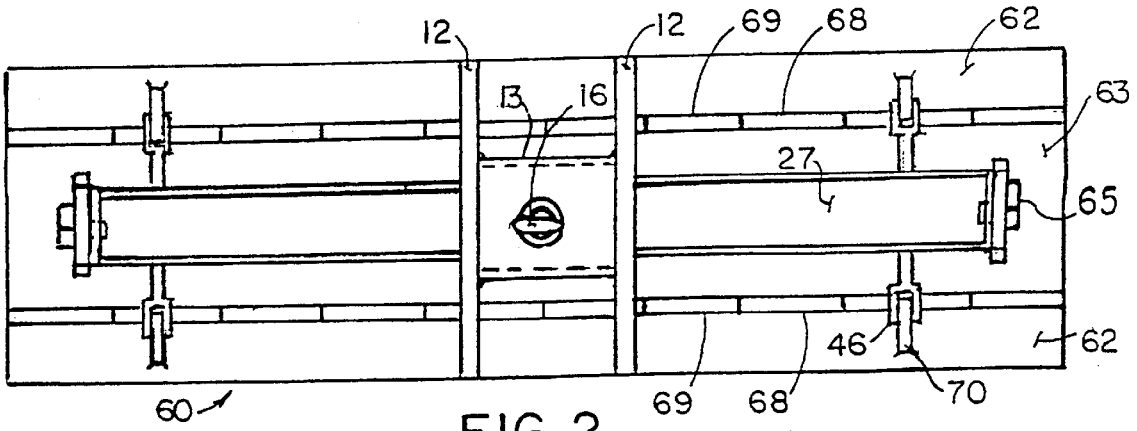
FIG. 2 is a top plan view thereof.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Referring now to the drawings for a description of the presently preferred embodiment of this invention, reference numeral 1 indicates an attachment of the present invention, adapted illustratively for use on a standard backhoe excavator.

The attachment 1 includes an adapter assembly 10, a main frame 20, two actuator assemblies 40, and a jaw assembly 60.

The adapter assembly 10 includes two upstanding ears 12 welded to the ends of a rectangular stiffening tube 13. Each ear 12 includes two holes 14. The spacing between the ears 12 and the spacing of the holes 14 are chosen, illustratively, to fit the mounting holes on the crowd arm and lever link, respectively, by which a bucket is mounted to a Ford backhoe excavator. The structure of such backhoe excavators is well known to those skilled in the art, and is not illustrated here.

At the center of the tube 13, a transverse hole accommodates a 3" solid steel shaft 15, which is welded to the tube 13. A lifting hook 16 is welded to the upper end of the shaft 15. The lower end 17 of the shaft 15 is turned and threaded for purposes to be described hereinafter.

The main frame 20 is about 33" long, about 42" tall, and about 4" wide. It includes a lower horizontal 4"×¼ square tube 21, having end plates 22 welded to its ends. The end plates 22 are tapped to receive mounting bolts as described hereinafter. The frame 20 also includes a pair of tubular spacer blocks 23 welded to the upper face of the horizontal tube 21 and spaced 7" from its ends. Six 4"×1½" channels complete the frame. Two 36" uprights 24 are welded to the top of the tube 21 at its ends, with their channels facing outward. Two 36" uprights 25 are welded to the top of the tube 21 at the outer ends of the spacer blocks 23, with their channels facing inward. The opening between the webs of each pair of uprights 24 and 25 is therefore 4". Actuator assemblies 40 are mounted in these openings as described hereinafter. A lower horizontal channel 26 is welded to the inner uprights 25 and to the spacer blocks 23, with its channel facing upward. An upwardly facing upper horizontal channel 27 is welded to the upper ends of the uprights 24 and 25. Between the upper channel 27 and lower channel 26, a vertical tube 28 is welded. Diagonal braces 29 are welded to the top of the tube 28 and the ends of the lower horizontal channel 26. The tube 28 has an inner diameter of 3", to accommodate the shaft 15. The shaft 15 extends through the tube 28. A washer 30 and nut 31 threaded onto the threaded end 17 of the shaft 15 pivotally mount the frame 20 to the adapter 10.

The actuator assemblies 40 include dual-acting hydraulic cylinders 41 having fittings 42 and 43 for hydraulic hoses, not shown. The fittings 42 are connected to a single auxiliary pressure/return hydraulic valve on the hydraulic device through a T-connection having a live swivel connection to the source. Likewise, the fittings 43 are connected through a live swivel T-connection to a single auxiliary pressure/return hydraulic valve on the hydraulic device. The upper end of each cylinder 41 is held between the channels 24 and 25 by a bolt 44. At the lower end of the cylinder 41, the end of the cylinder's piston 45 is provided with a clevis 46. Within the clevis 46, a first lever arm 47 is provided with a bifurcated end, and a second lever arm 48 is provided with a straight end. The ends of the lever arms 47 and 48 thus form a knuckle joint within the clevis 46. The knuckle joint formed by the clevis 46 and proximal ends of the arms 47 and 48 is keyed by a shaft 49, which is trapped between vertical plates 50 welded to the upright channels 24 and 25. The vertical orientation of the cylinder 41 and its piston 45 is thus positively maintained regardless of side loads placed on the actuator assembly 40. The vertical plates 50 are 6" long, although the total throw of the pistons 45 is about 4".

The free ends of the arms 47 and 48 are formed as clevises, for connection to the jaws of a replaceable jaw assembly 60, as described hereinafter.

The jaw assembly 60 includes a fixed plate assembly 61 and a pair of jaws 62. The jaw assembly illustrated is intended for use with standard 16" pipe, having an outside diameter of 17¼". The fixed plate assembly 61 includes an elongate steel plate 63, curved to match the curvature of the pipe. The plate 63 is about 41" long, 10" wide, and ½" thick. Toward each end of the plate 63, upstanding ears 64 provide mounts for bolting the plate 63 to the end plates 22 of the square tube 21 at the bottom of frame 20, by means of bolts 65. Spaced-apart ears 66 at the center of the plate 63 are drilled for passing a bolt 67 transversely through corresponding holes in the square tube 21.

The jaws 62 are also formed of ½" thick steel and have an inside curvature which matches the curvature of the outer surface of the pipe. Each jaw 62 measures about 17" along its inner curved surface and is 41" long. The long edges of the plate 63 and the upper long edges of the jaws 62 are provided with tube sections 68 and 69, respectively, which are held by a rod passing through them to form a piano hinge. On each jaw 62 two upstanding pivot arms 70 are welded to the outer surface of the jaw and positioned to be trapped in the clevis ends of the lever arms 47 and 48 and connected to the lever arms by bolts 71. The pivot arms 70 are reinforced with gussets 72, shown only in FIG. 1 for clarity.

The inner faces of the jaws 62 and elongate plate 63 are lined with 3/16" conveyor belting 73 having a 1/16" raised diamond pattern 74 on its exposed surface. Illustratively, the belting 73 is made of rubber reinforced with nylon fabric. The belting is an elastomer, and the raised pattern is compressed when the jaws are closed around a pipe section. The dimensions of the jaws and the actuator assembly are chosen to cause the elastomeric raised pattern to compress when the jaws are closed, but to limit the amount of pressure placed on the pipe section to an amount sufficient to permit the pipe to be moved axially in a trench into snug engagement with a previously laid section of pipe.

Figure 3:
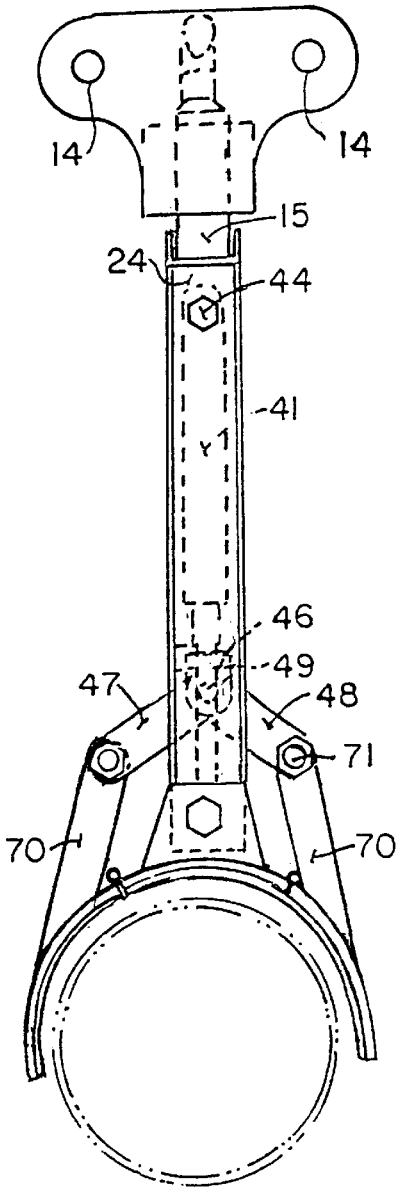
FIG. 3 is a view in end elevation thereof, showing the device in an open position.
Figure 4:
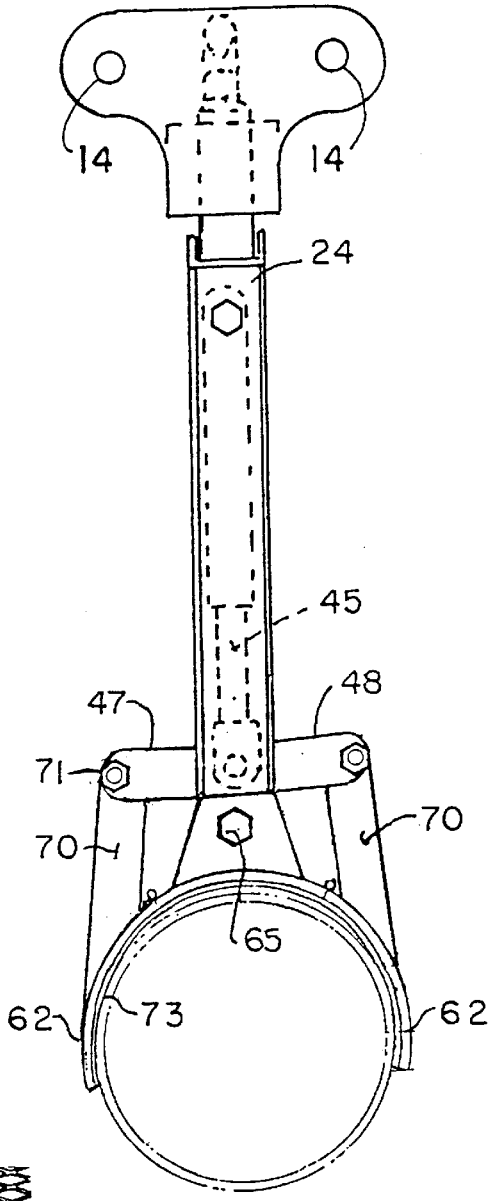
FIG. 4 is a view in end elevation, corresponding to FIG. 3, showing the device in a closed, gripping, position.
Figure 5:
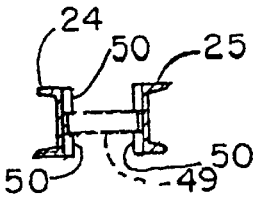
FIG. 5 is a sectional view, taken along the line 5—5 of FIG. 1.
Figure 6:
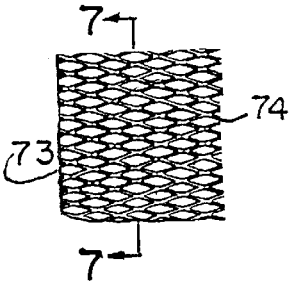
FIG. 6 is a detail of a liner material on a jaw of the device of FIGS. 1–3.
Figure 7:
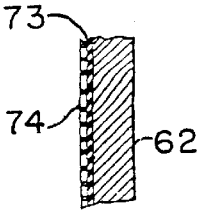
FIG. 7 is a sectional view taken along line 7—of FIG. 6.

As shown in FIG. 3, when the piston 45 of the hydraulic cylinder 41 is in its upward, withdrawn, position, the jaws 62 are spread about 20" apart, thereby leaving between two and three inches of clearance for grasping a pipe section. The jaws in this position therefore have an outside dimension of less than 22", and therefore permit use of the attachment to lay 16" pipe in a 22" trench. When the piston 45 is forced to its extended position, and the jaws 62 are closed, the lever arms 47 and 48 overcenter and produce a positive mechanical lock on the pipe. Thus, the piston 45 must be positively driven toward its withdrawn position in order to release the pipe section.

It will be seen that the jaw assembly 60 can easily be removed by removing the two end bolts 65, the transverse center bolt 67, and the four lever linkage bolts 71. By properly proportioning and positioning the pivot arms corresponding to the arms 70, the device will work with a broad range of sizes of jaw assemblies. For example, it has been found that a jaw assembly proportioned to handle 8" pipe having a 9" outer diameter can be given an opening of 11" between the open jaws. This provides a maximum outside dimension of about 12½" and permits laying an 8" pipe in a 13" trench.

The use of the attachment of the present invention permits a single operator, or an operator and a single helper not in the trench, to lay pipe in a trench without damaging the pipe or getting dirt into the seal between pipe sections. The attachment is preferably used with a hydraulic device which is, during the pipe laying operation, dedicated to laying pipe, rather than constantly switching between digging and laying operations.

In the illustrative embodiment, the bucket is removed from the crowd arm of a backhoe excavator and is replaced by the attachment of the invention. The two hydraulic hoses are attached to the device's auxiliary hydraulic valves. The excavator is then positioned straddling the previously dug trench, within reach of a pipe section which has been previously unloaded along side the trench. The attachment is lowered by means of the boom and crowd arm of the excavator until a corner of one jaw contacts the pipe. The attachment is then lowered onto the pipe and self-aligns onto the pipe by pivoting around the shaft 15. Because the attachment is symmetrical, this operation is greatly simplified, although the hydraulic lines limit rotation to about 360° and therefore require that the attachment rotate alternately clockwise and counterclockwise in successive operations. The jaw assembly is preferably lowered first into snug contact with the distant end of the pipe, then allowed to drop onto the nearer end of the pipe, which is more visible to the operator. It is preferred that the jaws grasp the pipe segment slightly off the center of gravity of the pipe. It has been found that the attachment can successfully manipulate a nine hundred pound pipe with an offset of up to three feet from the center of gravity. The jaws are then closed on the pipe. The large contact area between the jaws and the pipe, the elastomeric lining on the jaw assembly, and the limited movement of the hydraulic cylinder pistons all ensure that the pipe is not scratched or damaged.

The operator then pivots the hydraulic device around its vertical pivot to position the pipe segment above the trench. Preferably, the hydraulic device is pointed in the direction in which the pipe is being laid, and sits generally over the end of the last segment placed in the trench. By using the dip control of the crowd arm, the female end of the pipe segment is caused to swing away from the operator, with the male end facing the operator and slightly elevated. The pipe is then lowered into the trench. It will be seen that if desired the side of the trench can be used for aligning and steadying oscillation of the pipe section as it is lowered. When the pipe section touches the bottom of the trench, it is pulled toward the operator and into snug engagement with the female end of the previously laid section. The jaws are then opened, and because of their relatively narrow width, the attachment is easily removed from the trench. In picking up, aligning, and placing the following piece of pipe, the operator causes the pipe to swing in an opposite direction from the previous pipe section, to prevent the hydraulic lines from constricting rotational movement of the frame.

In view of the above, it will be seen that the several objects and advantages of the present invention have been achieved and other advantageous results have been obtained.

Numerous variations in the pipe laying attachment of the present invention, within the scope of the appended claims will occur to those skilled in the art in light of the foregoing disclosure. Merely by way of example, the shaft 15 could be made hollow and the hydraulic lines run through it to a live swivel connector. This variation would provide complete rotatability of the frame and would eliminate any concern about the direction the frame turns or the number of revolutions it makes. The attachment may be used to lay other buried utility pipes than water mains. As various other changes could be made in the above constructions without departing from the scope of the invention, it is intended that all matter contained in the above description or shown in the accompanying drawings shall be interpreted as illustrative and not in a limiting sense.

I claim:

1. A pipe having attachment for a hydraulically powered device, the attachment comprising an elongate horizontal frame; two elongate jaws, each jaw having an inside curvature which matches a curvature of an outer surface of a pipe section to be laid by the attachment, each jaw having a length and a height the length being substantially greater than the height, each jaw being removably mounted to the frame along a proximal long edge of the jaw by a piano hinge extending substantially the entire length of the jaw, and an elastomeric liner on an inside surface of each jaw, the jaws being moveable between an open position in which distal long edges of the jaws are spaced apart sufficiently to receive the pipe section and a closed position in which the distal long edges are pivoted toward each other sufficiently to grip the pipe section along substantially the entire length of the jaws.

2. The pipe laying attachment of claim 1 wherein the elastomer includes a raised pattern on its surface, the pattern being compressed against the pipe section when the jaws are closed.

3. An attachment for a hydraulically powered device, the attachment comprising an elongate frame; a first elongate jaw pivotably mounted to and a second elongate jaw pivotably mounted to the frame, the jaws being moveable between an open position in which distal long ends of the jaws are spaced apart sufficiently to receive a pipe section and a closed position in which the distal long ends are pivoted toward each other sufficient to grip the pipe section; a pair of first links pivotably attached to the first jaw, a pair of second links pivotably attached to the second jaw, and two dual-acting hydraulic cylinders, each having an upper end attached to the frame and a second end pivotably attached to a respective one of the first links and to a respective one of the second links, each cylinder having a pressure line and a return line to control both expansion and contraction of the cylinder, the pressure lines of each cylinder being connected to a common pressure source.

4. An attachment for a hydraulically powered device, the attachment comprising an elongate frame; a first jaw pivotably mounted to the frame and a second jaw pivotably mounted to the frame, the jaws being moveable between an open position in which distal ends of the jaws are spaced apart sufficiently to receive a pipe section and a closed position in which the distal ends are pivoted toward each other sufficient to grip the pipe section; a first link pivotably attached to the first jaw, a second link pivotably attached to the second jaw, and a dual-acting hydraulic cylinder having an upper end attached to the frame and a second end attached to a pivot rod, the first and second links being pivotably attached to the pivot rod, the pivot rod being slidably mounted to the frame in a slide mount comprising a pair of spaced-apart rails at each end of the pivot rod.

5. An attachment for a hydraulically powered device, the attachment comprising an elongate frame; a first elongate jaw pivotably mounted to the frame and a second jaw pivotably mounted to the frame, the jaws being moveable between an open position in which distal long ends of the jaws are spaced apart sufficiently to receive a pipe section and a closed position in which the distal long ends are pivoted toward each other sufficient to grip the pipe section; two first links pivotably attached to the first jaw, two second links pivotably attached to the second jaw, and two dual-acting hydraulic cylinders, one cylinder having an upper end attached to the frame and a second end attached to a first pivot rod, the other cylinder having an upper end attached to the frame and a second end attached to a second pivot rod, the one first link and one second link being pivotably attached to the first pivot rod, and the other first link and other second link being pivotably attached to the second pivot rod.

6. The attachment of claim 5 wherein one first link, one second link, one hydraulic cylinder, and one pivot rod is positioned at each end of the frame.

7. An attachment for a hydraulically powered device, the attachment comprising an elongate frame; a first jaw pivotably mounted to one side of the frame and a second jaw pivotably mounted to an opposed side of the frame, the jaws being moveable between an open position in which distal long ends of the jaws are spaced apart sufficiently to receive a pipe section and a closed position in which the distal long ends are pivoted toward each other sufficient to grip the pipe section; a first link pivotably attached to the first jaw, a second link pivotably attached to the second jaw, and a dual-acting hydraulic cylinder having an upper end attached to the frame and a second end pivotably attached to the first link and the second link, the links being positioned so as to overcenter when the jaws are closed, thereby locking the jaws closed until the hydraulic cylinder is driven to a contracted position, the hydraulic cylinder being gravity-biased away from the contracted position.

8. An attachment for attachment to an arm of a hydraulically powered device, the attachment comprising an adapter assembly mounted to a dip control of the arm, and an elongate frame; a first jaw pivotably mounted to one side of the frame and a second jaw pivotably mounted to an opposed side of the frame, the jaws being moveable between an open position in which distal ends of the jaws are spaced apart sufficiently to receive a pipe section and a closed position in which the distal long ends are pivoted toward each other sufficient to grip the pipe section; the frame being mounted to the adapter assembly by an adapter pivot, the adapter pivot being centered with respect to the frame, the frame being symmetric with respect to the adapter pivot, the adapter pivot permitting free rotation of the frame with respect to the arm of the hydraulic device, whereby angular position of the pipe section may be controlled by using the dip control of the arm of the hydraulic device.

9. An attachment for a hydraulically powered device, the attachment comprising an elongate frame, and two elongate jaws, each jaw being pivotably mounted to the frame, the jaws being moveable between an open position in which distal long edges of the jaws are spaced apart sufficiently to receive a pipe section having an outside diameter of about seventeen inches and a closed position in which the distal long edges are pivoted toward each other sufficiently to grip a portion of the pipe section along substantially the entire length of the jaws, the attachment being so proportioned that when the jaws are in an open position the total width of the attachment is no greater than five inches larger than the outside diameter of the portion of the pipe section gripped by the jaws.

10. The attachment of claim 9 wherein the frame is mounted to an adapter pivot which mounts the attachment to the hydraulic device, the adapter pivot being centered with respect to the frame, and the frame being substantially symmetric with respect to the adapter pivot.

11. An attachment for a hydraulically powered device, the attachment comprising an adapter assembly, an elongate frame pivotally connected to the adapter assembly, and an elongate jaw assembly, the jaw assembly comprising an elongate attachment part detachably mounted to the frame and two elongate jaws, at least one elongate jaw being pivotably mounted to the attachment part along a proximal long edge of the jaw, the jaw being moveable between an open position in which distal long edges of the jaws are spaced apart sufficiently to receive a pipe section and a closed position in which the distal long edges are pivoted toward each other sufficiently to grip the pipe section along substantially the entire length of the jaws.

12. The attachment of claim 11 wherein the jaws are pivotably mounted to the attachment part along proximal long edges of the jaw.

13. The attachment of claim 12 further comprising a hydraulic actuator assembly for opening and closing the jaws.

14. The attachment of claim 13 further comprising a linkage between the hydraulic actuator assembly and the jaws, the linkage overcentering when the jaws are in their closed position to mechanically lock the jaws in their closed position.

15. The attachment of claim 14 wherein the linkage comprises a plurality of arms, each arm having one end pivotably attached to a pivot rod slidably mounted to the frame and a second end pivotably attached to one of said jaws, the arms and jaws being so proportioned that the arms are useable with jaws of different sizes for use with pipe of different diameters.

16. The attachment of claim 11 wherein the frame is pivotably mounted to the adapter assembly through a pivot centered with respect to the frame, the frame being symmetric with respect to the pivot.

17. The attachment of claim 11 wherein the elongate attachment part comprises an elongate plate having upstanding ears, the attachment further comprising connectors attached to the frame and the ears.

18. The attachment of claim 17 wherein the connectors are bolts.

19. The attachment of claim 11 wherein each jaw includes an elastomeric liner, having a raised pattern on its surface, the pattern being compressed against the pipe section when the jaws are closed.

* * * * *

UNITED STATES PATENT AND TRADEMARK OFFICE

CERTIFICATE OF CORRECTION

PATENT NO. : 5,918,923
DATED : July 6, 1999
INVENTOR(S) : Richard L. Killion

It is certified that error appears in the above-identified patent and that said Letters Patent is hereby corrected as shown below:

Column 3,
Line 30, after the word "line", it should read --- 7-7 ---;

Column 6,
Line 48, claim 1, after the word pipe, it reads "having", it should read --- laying ---.

Signed and Sealed this

Eleventh Day of September, 2001

Nicholas P. Godici

*Attest:*

NICHOLAS P. GODICI
*Acting Director of the United States Patent and Trademark Office*

*Attesting Officer*